US011974648B1

(12) United States Patent
Sugermeyer

(10) Patent No.: US 11,974,648 B1
(45) Date of Patent: May 7, 2024

(54) MAKEUP AND SKINCARE APPLICATOR

(71) Applicant: Jennifer Sugermeyer, Irving, TX (US)

(72) Inventor: Jennifer Sugermeyer, Irving, TX (US)

( * ) Notice: Subject to any disclaimer, the term of this patent is extended or adjusted under 35 U.S.C. 154(b) by 0 days.

(21) Appl. No.: 18/519,776

(22) Filed: Nov. 27, 2023

Related U.S. Application Data

(63) Continuation-in-part of application No. 18/244,602, filed on Sep. 11, 2023.

(60) Provisional application No. 63/442,073, filed on Jan. 30, 2023.

(51) Int. Cl.
*A45D 34/04* (2006.01)
*A45D 40/26* (2006.01)

(52) U.S. Cl.
CPC ..... *A45D 34/04* (2013.01); *A45D 40/26* (2013.01)

(58) Field of Classification Search
CPC ..... A45D 34/04; A45D 40/26
USPC ..... 132/320
See application file for complete search history.

(56) References Cited

U.S. PATENT DOCUMENTS 8,267,097 B2 * 9/2012 Abergel ..... A45D 34/04 132/73

FOREIGN PATENT DOCUMENTS

CN 212382252 U * 1/2021
KR 20100024189 A * 3/2010

* cited by examiner

*Primary Examiner* — Jennifer C Chiang
(74) *Attorney, Agent, or Firm* — Richard Eldredge; Leavitt and Eldredge Law Firm

(57) ABSTRACT

A makeup and skincare applicator comprising, a head, a neck, and a handle, wherein the head has an indentation near the neck and is designed to have a convex end at the tip and the handle can be flat or circular in shape with a round end and the makeup and skincare applicator resembles the shape of a spoon and is ergonomically designed and is made of natural or artificial stone or mineral.

3 Claims, 4 Drawing Sheets

MAKEUP AND SKINCARE APPLICATOR

CROSS-REFERENCE TO RELATED APPLICATIONS

This application is a continuation of U.S. Provisional Application No. 63/442,073, filed on Jan. 30, 2023, and Nonprovisional application Ser. No. 18/244,602, filed on Sep. 11, 2023, which is hereby incorporated by reference in its entirety.

BACKGROUND

1. Field of the Invention

The present invention generally relates to beauty tools, and more specifically to a makeup and skincare applicator for applying makeup or skincare products to the skin or face.

2. Description of Related Art

Traditional methods of applying makeup and skincare products and methods use a brush, sponge, or finger to apply beauty products like foundation, concealer, blush, lotion, cream, serum, etc. to the skin. These methods result in the wastage of beauty products as they absorb liquid beauty products, resulting in the growth of bacteria, which can be harmful to the skin and need regular cleaning or replacement with new brushes or sponges which in turn consumes time and money. Using fingers can be unhygienic due to the transfer of oils and bacteria to the skin and can stain the clothing articles if not cleaned properly.

One of the problems commonly associated with traditional makeup and skincare applicators and methods is limited efficiency in creating a hygienic applicator or tools and methods for applying makeup or skincare products.

Accordingly, although great strides have been made in the area of makeup and skincare applicators, many shortcomings remain.

DESCRIPTION OF THE DRAWINGS

The novel features believed characteristic of the embodiments of the present application is set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
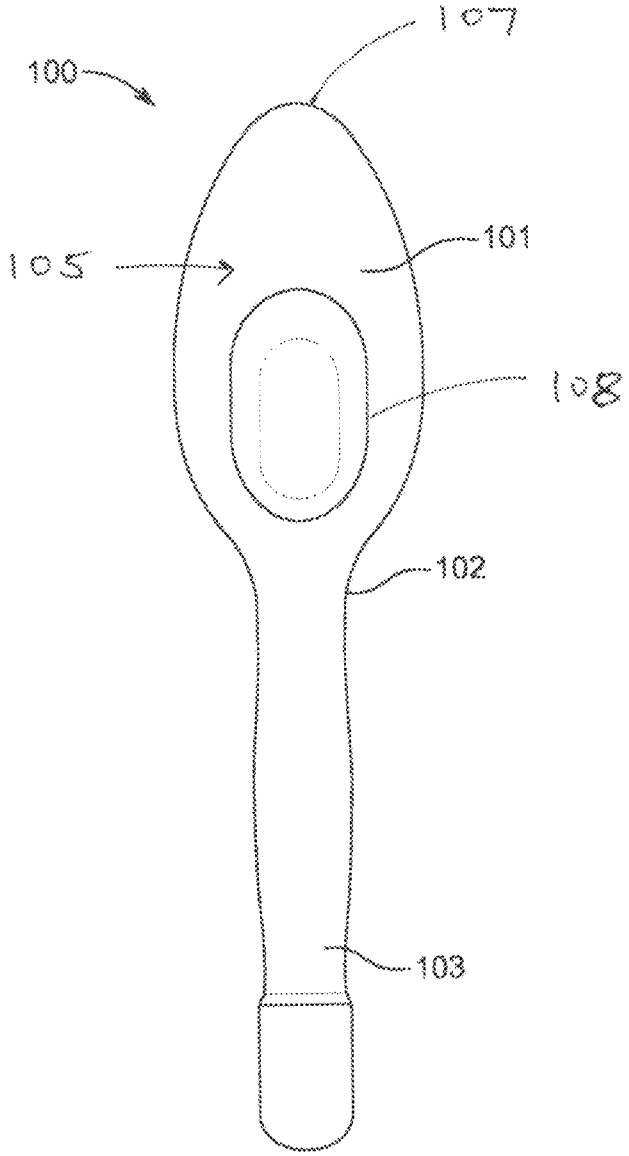
FIG. 1 is a top view of a makeup and skincare applicator of the present invention.

While the makeup and skincare applicator and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the makeup and skincare applicator and the method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The makeup and skincare applicator can be interchangeably referred to as the applicator or application tool or makeup and skincare application tool within the entirety of this application without modifying the scope of the present invention.

The makeup and skincare applicator and method of use in accordance with the present application overcomes one or more of the above-discussed problems commonly associated with known makeup and skincare applicators. Specifically, the makeup and skincare applicator of the present invention provides an ergonomic makeup and skincare applicator made of jade stone resembling a spoon, which does not absorb the beauty product and facilitates safe, accurate, and even distribution of all kinds of beauty products. The makeup and skincare applicator of the present invention is durable, easy to use, easy to clean, requires minimal makeup or skincare product for full skin coverage, and is suitable for all skin types and age groups.

These and other unique features of the makeup and skincare applicator and method of use are discussed below and illustrated in the accompanying drawings.

The makeup and skincare applicator and method of use will be understood, both as to its structure and operation, from the accompanying drawings, taken in conjunction with the accompanying description. Several embodiments of the makeup and skincare applicator are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein reference characters identify corresponding or similar elements throughout the several views, FIGS. 1-4 depict the makeup and skincare applicator in accordance with a preferred embodiment of the present application. It will be appreciated that makeup and skincare applicator 100 overcomes one or more of the above-listed problems commonly associated with conventional makeup and skincare applicators. In addition, it should be appreciated that more or fewer of such components may be included in different embodiments of the makeup and skincare applicator 100.

Figure 2:
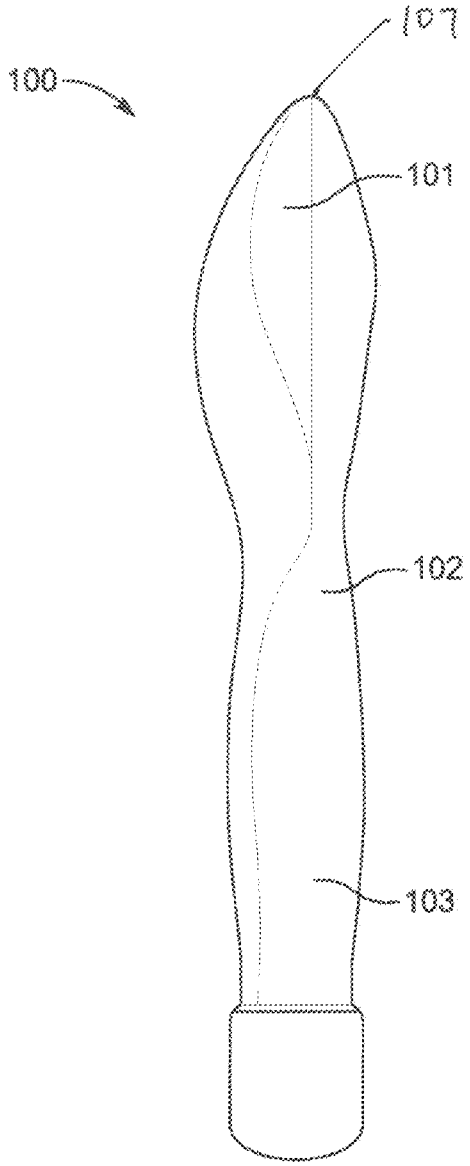
FIG. 2 is a side view of a makeup and skincare applicator of FIG. 1.
Figure 3:
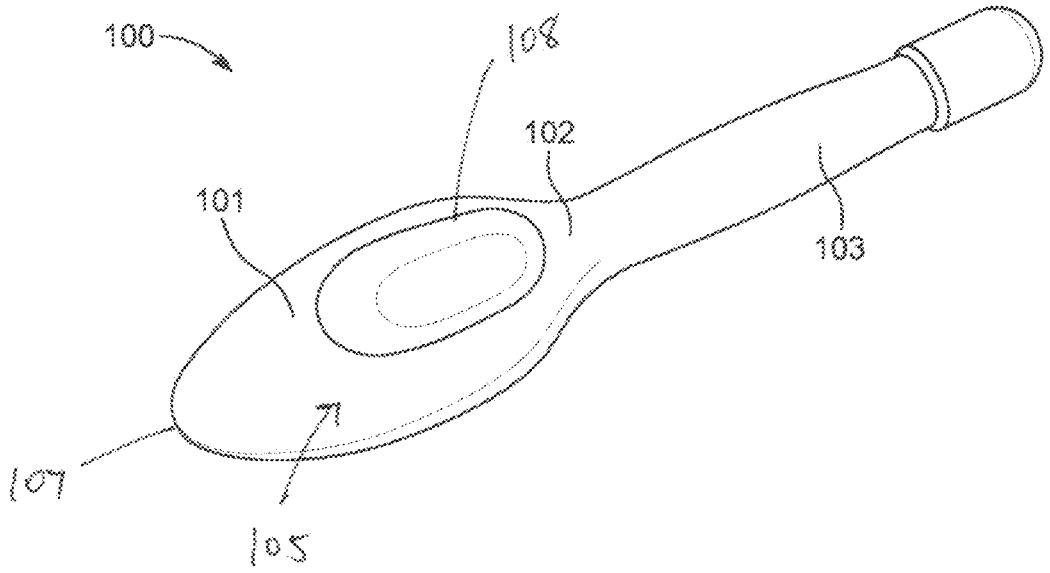
FIG. 3 is a perspective view of a makeup and skincare applicator of FIG. 1.

In the contemplated embodiment, the makeup and skincare applicator 100 in the form of a spoon includes a head 101, a neck 102, and a handle 103. The head 101 having a surface 105 with an indentation 108 extending from surface 105 and positioned near the neck 102 and is designed to have a convex end at the tip 107 as shown in FIGS. 1-3. The indentation is positioned nearer the neck 102 than the tip 107.

Figure 4:
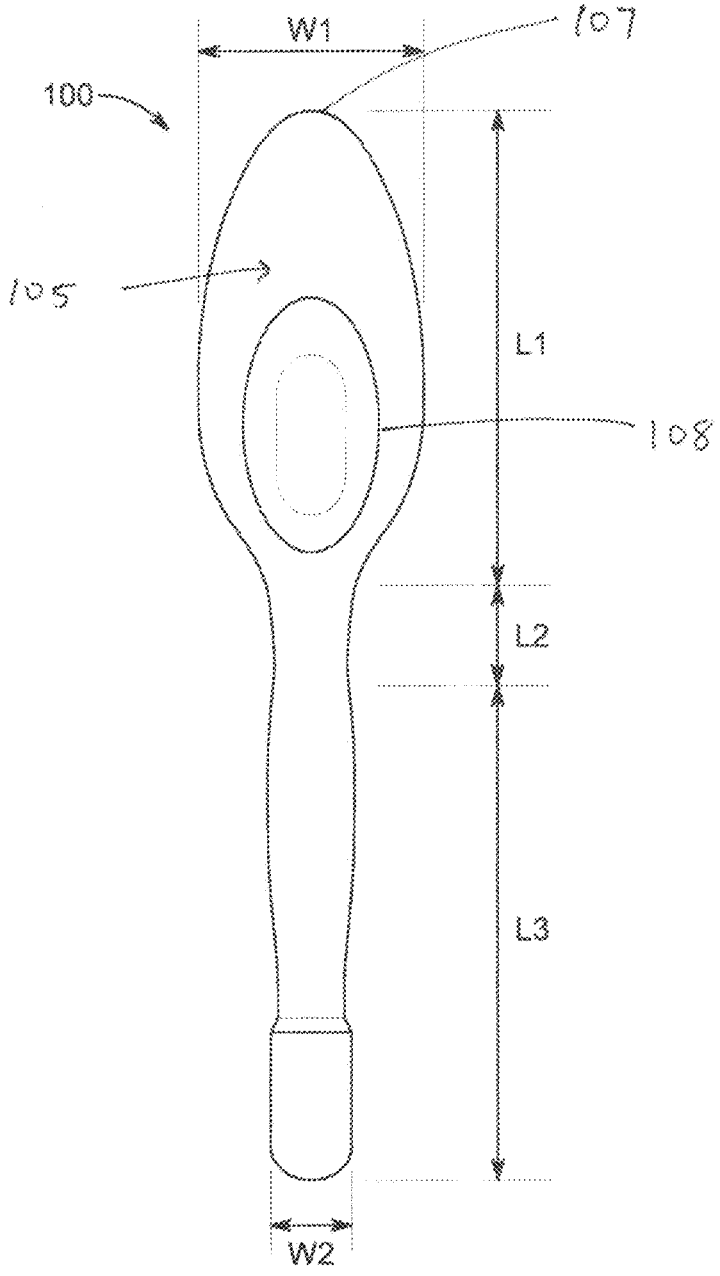
FIG. 4 is a makeup and skincare applicator according to the preferred embodiment of the present invention.

The head 101 can be 2" in length L1 and 1.35" in width W1, the neck 102 can be 0.25" in length L2 and the handle 103 can be 2.5" in length L3 and 0.5" in width W3 as shown in FIG. 4. The head 101 can be oval in shape, and the neck 102 and handle 103 can be flat or round in shape. The neck 102 can be tapered and the handle 103 can have a round terminal end with a bulge along the length for ergonomically fitting in the hand.

The makeup and skincare applicator 100 can be made of any natural or synthetic material including but not limited to jade or any other suitable mineral or stone in different colors that are similar in weight and functionality.

The makeup and skincare applicator 100 of the present invention can help in reducing inflammation with the cooling effects of the material, massaging the face, and even application of liquid skincare and makeup products. The makeup and skincare applicator 100 of the present invention does not absorb beauty products causing wastage, is easy to clean, and does not provide a breeding ground for bacteria.

The makeup and skincare applicator 100 is ergonomically suitable for use around the eyes, nose, and face or any other part of skin during makeup and skincare product application. It helps in providing even application, a way to optimize product without waste, a cooling and soothing, spa-like experience, and a way to massage the face and target undereye bags while applying liquid products to the face or skin. It is easy to clean and easy to carry.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A makeup and skincare applicator comprising:

a head forming an oval shape and extends from a tip to a neck end, the head further forming a curved indented surface;

an indentation extending from the curved indented surface of the head, the indentation forming an indented oval shape and positioned nearer to the neck end than the tip, the indentation extending in a direction away from the curved indented surface of the head; and a handle secured to the neck opposite the head;

wherein said handle can be flat or circular in shape with a round end;

wherein the makeup and skincare applicator resemble the likeness of a spoon.

2. The makeup and skincare applicator of claim 1, is ergonomically suitable for use around the eyes, nose, and face or any other part of skin during makeup and skincare product application.

3. The makeup and skincare applicator of claim 1, is made of jade or any other suitable natural or artificial stone or mineral.

* * * * *